US009359984B2

(12) United States Patent
Lyubar et al.

(10) Patent No.: US 9,359,984 B2
(45) Date of Patent: Jun. 7, 2016

(54) VALVE ASSEMBLY FOR AN INJECTION VALVE AND INJECTION VALVE

(75) Inventors: Anatoliy Lyubar, Regensburg (DE); Antonio Agresta, Pisa (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 126 days.

(21) Appl. No.: 13/880,726

(22) PCT Filed: Oct. 14, 2011

(86) PCT No.: PCT/EP2011/068005

§ 371 (c)(1), (2), (4) Date: Jul. 31, 2013

(87) PCT Pub. No.: WO2012/052364

PCT Pub. Date: Apr. 26, 2012

(65) Prior Publication Data

US 2013/0299611 A1 Nov. 14, 2013

(30) Foreign Application Priority Data

Oct. 19, 2010 (EP) ..... 10188087

(51) Int. Cl.

| | |
|---|---|
| ***F02M 51/00*** | (2006.01) |
| ***F02M 45/00*** | (2006.01) |
| ***F02M 45/12*** | (2006.01) |
| ***F02M 37/00*** | (2006.01) |
| ***F02M 63/00*** | (2006.01) |

(Continued)

(52) U.S. Cl.

CPC ..... *F02M 51/0628* (2013.01); *F02M 51/0625* (2013.01); *F02M 61/10* (2013.01)

(58) Field of Classification Search

CPC ..... F02M 51/0671; F02M 51/0685; F02M 51/0682; F02M 63/0075; F02M 61/166

USPC ..... 239/584.3, 584.4, 585.2, 585.3, 585.1, 239/533.2, 586, 581.1, 585.5

See application file for complete search history.

(56) References Cited

U.S. PATENT DOCUMENTS 5,694,903 A * 12/1997 Ganser ..... 123/496
6,510,841 B1 1/2003 Stier ..... 123/472

(Continued)

FOREIGN PATENT DOCUMENTS

DE 10113008 A1 5/2002 ..... F02M 47/02
DE 10332812 A1 2/2005 ..... F02M 51/06

(Continued)

OTHER PUBLICATIONS

European Search Report, Application No. 10188087.0, 4 pages, Mar. 30, 2011.

(Continued)

*Primary Examiner* — Arthur O Hall
*Assistant Examiner* — Christopher R Dandridge
(74) *Attorney, Agent, or Firm* — Slayden Grubert Beard PLLC

(57) ABSTRACT

A valve assembly for an injection valve may include a valve body having a central longitudinal axis and a cavity with a fluid inlet portion and a fluid outlet portion, the fluid inlet portion having a step, a valve needle axially movable in the cavity, the valve needle preventing a fluid flow through the fluid outlet portion in a closing position and releasing the fluid flow through the fluid outlet portion in an open position, and an electro-magnetic actuator unit configured to actuate the valve needle and comprising an axially movable armature, the armature including a first armature part fixedly coupled to the valve needle and a second armature part axially movable relative to the first armature part, the second armature part configured such that the second armature part is mechanically decoupled from the first armature part by hitting the step when the valve needle reaches its open position.

19 Claims, 3 Drawing Sheets

(51) Int. Cl.
*F02M 51/06* (2006.01)
*F02M 61/10* (2006.01)

(56) References Cited

U.S. PATENT DOCUMENTS

| | | | | |
|---|---|---|---|---|
| 6,796,543 | B2 | 9/2004 | Haeberer et al. | 251/50 |
| 2003/0019959 | A1* | 1/2003 | Brenk | F02M 61/161 239/585.5 |
| 2003/0029941 | A1* | 2/2003 | Keim | 239/585.1 |
| 2003/0116657 | A1 | 6/2003 | Nakayama et al. | 239/585.1 |
| 2004/0050977 | A1* | 3/2004 | Rieger | F02M 51/0685 239/585.1 |
| 2008/0277505 | A1* | 11/2008 | Hoang | 239/585.5 |
| 2012/0080542 | A1* | 4/2012 | Imai | F02M 51/0671 239/533.2 |

FOREIGN PATENT DOCUMENTS

| | | | | |
|---|---|---|---|---|
| EP | 1801409 | A1 | 6/2007 | F02M 51/06 |
| EP | 2138705 | A1 | 12/2009 | F02M 47/02 |
| EP | 2236807 | A1 | 10/2010 | F02M 51/06 |
| EP | 2444651 | A1 | 4/2012 | F02M 51/06 |
| JP | 2002310029 | A | 10/2002 | F02M 51/06 |
| WO | 2012/052364 | A1 | 4/2012 | F02M 51/06 |

OTHER PUBLICATIONS

International Search Report and Written Opinion, Application No. PCT/EP2011/068005, 10 pages, Nov. 8, 2011.

European Search Report, Application No. 14151658.3, 7 pages, May 13, 2014.

* cited by examiner

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2011/068005 filed Oct. 14, 2011, which designates the United States of America, and claims priority to EP Application No. 10188087.0 filed Oct. 19, 2010, the contents of which are hereby incorporated by reference in their entirety.

TECHNICAL FIELD

This disclosure relates to a valve assembly for an injection valve and an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar and even higher, and in the case of diesel engines in the range of up to 2000 bar and even higher.

SUMMARY

One embodiment provides a valve assembly for an injection valve, comprising: a valve body including a central longitudinal axis, the valve body comprising a cavity with a fluid inlet portion and a fluid outlet portion, the fluid inlet portion being provided with a first step; a valve needle axially movable in the cavity, the valve needle preventing a fluid flow through the fluid outlet portion in a closing position and releasing the fluid flow through the fluid outlet portion in an open position; and an electro-magnetic actuator unit being designed to actuate the valve needle, the electro-magnetic actuator unit comprising an armature axially movable in the cavity; wherein the armature comprises a first armature part being fixedly coupled to the valve needle and a second armature part being axially movable relative to the first armature part, the second armature part being designed in a way that the second armature part is mechanically decoupled from the first armature part by hitting the first step when the valve needle reaches its open position.

In a further embodiment, the second armature part is arranged relative to the first armature part in axial direction towards the fluid outlet portion.

In a further embodiment, the second armature part is axially movable between the first armature part and a stop device.

In a further embodiment, the stop device comprises a second step in the valve body.

In a further embodiment, the stop device comprises an armature spring fixedly coupled to the valve body.

In a further embodiment, the armature spring is a coil spring being coupled to the second step in the valve body.

In a further embodiment, the stop device comprises a protrusion extending in radial direction from the valve needle and being rigidly coupled to the valve needle.

In a further embodiment, there is a given distance between the first step and the second armature part, when the valve needle is in its closing position.

In a further embodiment, the given distance has a value of 5 to 20 μm.

In a further embodiment, the second armature part is of a magnetic material.

In a further embodiment, the second armature part is of a non-magnetic material.

Another embodiment provides an injection valve including a valve assembly according to any of the embodiments disclosed above.

BRIEF DESCRIPTION OF THE DRAWINGS

Exemplary embodiments will be explained in more detail below based on the schematic drawings, wherein.

DETAILED DESCRIPTION

Figure 1:
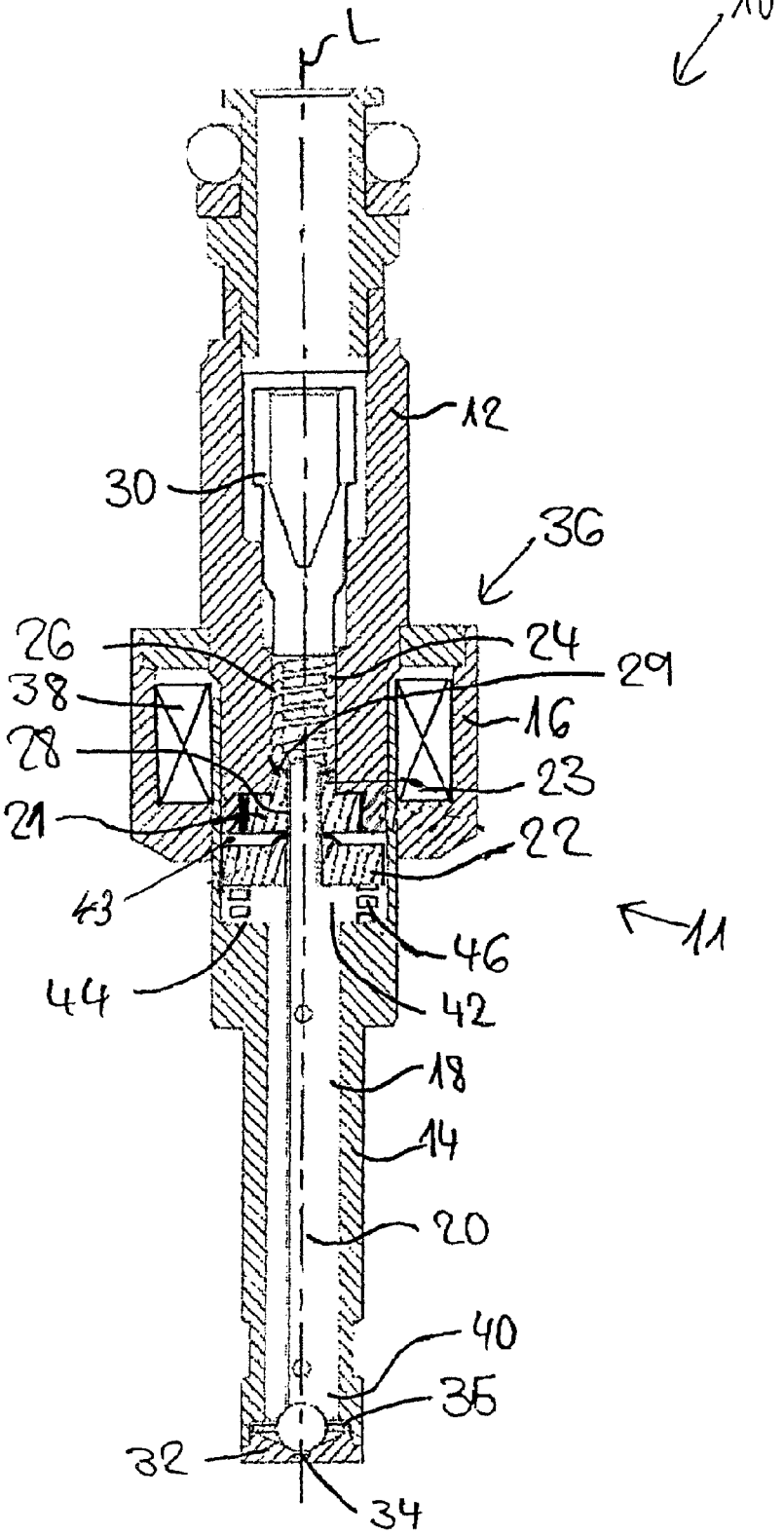
FIG. 1, an injection valve with a first embodiment of a valve assembly in a longitudinal section view, FIG. 2, an arrangement of a first and of a second armature part and of a valve needle, all of a valve assembly according to an example embodiment, in an enlarged view.

Embodiments of the present disclosure provide a valve assembly and an injection valve which facilitate a reliable and precise function.

Some embodiments provide a valve assembly for an injection valve, comprising a valve body including a central longitudinal axis, the valve body comprising a cavity with a fluid inlet portion and a fluid outlet portion, the fluid inlet portion being provided with a first step, and a valve needle axially moveable in the cavity, the valve needle preventing a fluid flow through the fluid outlet portion in a closing position and releasing the fluid flow through the fluid outlet portion in an open position. Furthermore, the valve assembly comprises an electro-magnetic actuator unit which is designed to actuate the valve needle. The electro-magnetic actuator unit comprises an armature which is axially movable in the cavity. The armature comprises a first armature part being fixedly coupled to the valve needle and a second armature part being axially movable relative to the first armature part. The second armature part is designed in a way that the second armature part is mechanically decoupled from the first armature part by hitting the first step when the valve needle reaches its open position.

When, in operation, moving the valve needle from the open position to the closing position, the first armature part is, together with the valve needle, moved from the open position in direction to the fuel outlet position. Thereby it meets the second armature part and hits it. When hitting, the first armature part hands over kinetic energy as a pulse to the second armature part according to Newton's law. Subsequently, the first armature part is accelerated again due to the force of the main spring until the valve needle reaches its closing position. The closing position is reached at a lower speed of the needle compared with a valve assembly, where the armature consists only of one piece having the mass of both of the armature parts of the valve assembly disclosed herein. This has the advantage that the first armature part can guide the valve needle in the valve body in a reliable manner and the second armature part can move in the cavity with a limited dependency from the first armature part. Due to the separation of the second armature part from the first armature part it can be avoided that the mass of the second armature part influences the dynamic behavior of the valve needle during the closing process of the injection valve. As the first armature part can have a small mass, the dynamic forces of the valve needle on the valve body can be kept small. Consequently, wearing effects on the valve body due the valve needle can be kept small. Furthermore, the second armature part can contribute to a maximum electromagnetic force on the valve needle during the opening phase of the valve needle and a secure opening of the valve needle can be obtained in case that the second armature part is of magnetic material.

If the mass of the first armature part plus the mass of the valve needle is equal to the mass of the second armature part, then all of the kinetic energy of the first armature part plus the mass of the valve needle is handed over to the second armature part, when the first armature part hits the second armature part. Independently of the mass relation between the mass of the second armature part versus the added masses of the valve needle plus the first armature part the danger of bouncing (=unwanted reopening of the needle immediately after reaching the closing position) is avoided or, at least, minimized by splitting the armature into two armature parts.

As the valve needle reaches its closing position at a lower speed compared with a traditional valve assembly, where the armature consists only of one piece, the so-called seat detection signal is smaller than with a traditional valve assembly. This might create problems in detecting the seat detection signal. However, the disclosed valve assembly has the advantage, that instead a signal can be detected, when the first armature part hits the second armature part. This signal is of a good quality, and it can be used analog to said seat detection signal.

In an advantageous embodiment the second armature part is arranged relative to the first armature part in axial direction towards the fluid outlet portion. By this a simple arrangement of the first armature part and the second armature part is possible.

In a further advantageous embodiment the second armature part is axially movable between the first armature part and a stop device. This has the advantage that a defined axial movement range of the second armature part can be obtained.

In a further advantageous embodiment the stop device comprises a second step in the valve body. By this a simple embodiment of the stop device is possible.

In a further advantageous embodiment the stop device comprises an armature spring fixedly coupled to the valve body. By this a soft, elastic movement of the second armature part and a reliable transmission of the kinetic energy from the second armature part to the stop device are possible.

In a further advantageous embodiment the armature spring is a coil spring being coupled to the second step in the valve body. This has the advantage that a simple shape of the armature spring and a secure arrangement of the armature spring in the cavity of the valve body can be obtained. Furthermore, a reliable transmission of the kinetic energy from the second armature part to the armature spring and further to the valve body can be obtained.

In a further advantageous embodiment the stop device comprises a protrusion extending in radial direction from the valve needle and being rigidly coupled to the valve needle. This has the advantage that a limited displacement between the first and the second armature part is possible. Furthermore, the shape of the stop element can be very simple.

In a further advantageous embodiment the second armature part is of a magnetic material. By this the second armature part can contribute to a maximum electromagnetic force on the valve needle during the opening phase of the valve needle and a secure opening of the valve needle can be obtained.

However, in another advantageous embodiment the second armature part is of a non-magnetic material. This has the advantage, that in a case, where a second armature part made of magnetic material might have negative influence onto the valve needle, such an influence can be avoided.

An injection valve 10 that is in particular suitable for dosing fuel to an internal combustion engine is shown in FIG. 1. It comprises in particular a valve assembly 11 and an inlet tube 12.

The valve assembly 11 comprises a valve body 14 with a central longitudinal axis L and a housing 16. The housing 16 is partially arranged around the valve body 14. A cavity 18 is arranged in the valve body 14.

Figure 2:
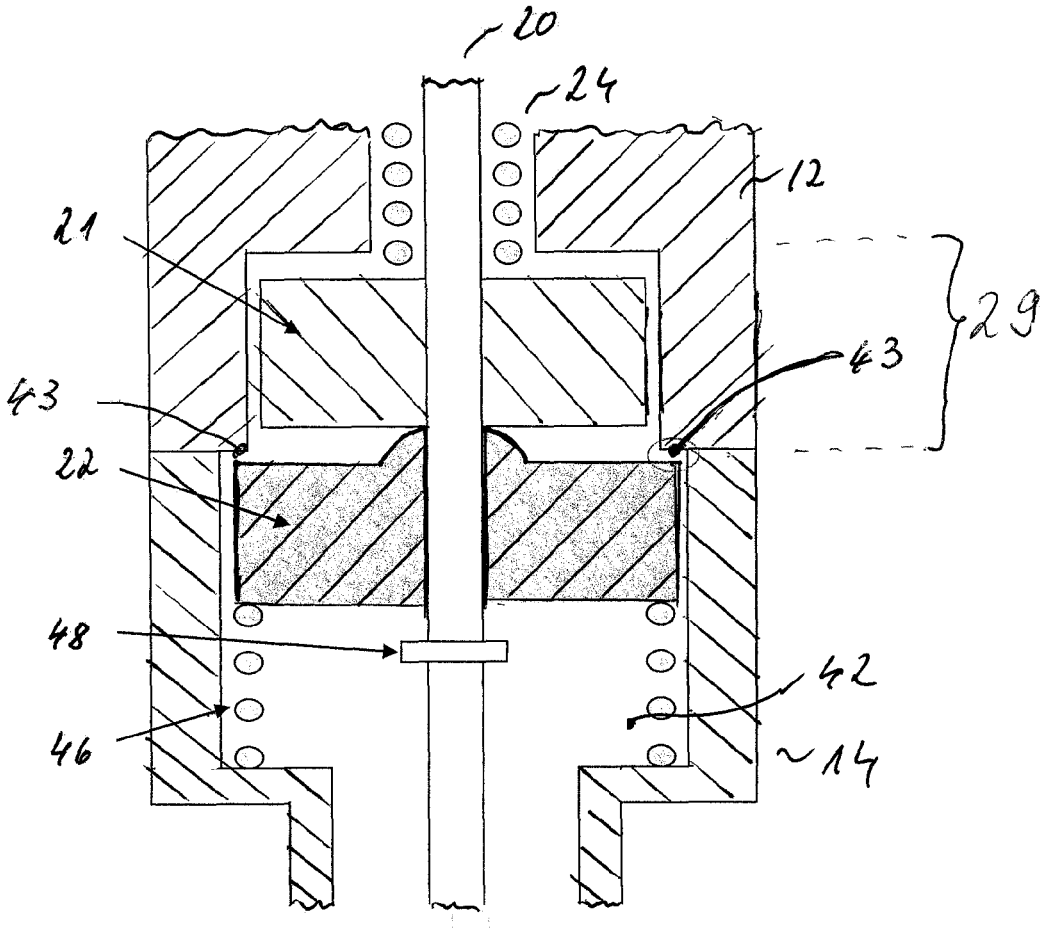

The cavity 18 takes in a valve needle 20, a first armature part 21 and a second armature part 22, which will be described in detail later. The first armature part 21 may have an upper guide 23 formed as a collar around the valve needle 14, as shown in FIG. 1. A main spring 24 is arranged in a recess 26 provided in the inlet tube 12. The main spring 24 is mechanically coupled to the upper guide 23 at an axial end 29 of the upper guide 23. The upper guide 23 is in one piece with the armature 21. The upper guide 23 is in contact with an inner side of the inlet tube 12 and can guide the valve needle 14 in axial direction inside the inlet tube 12. Alternatively, the upper guide 23 is arranged adjacent to an axial end of the valve needle 20 and is fixedly coupled to the valve needle 20. However, it is not necessary to have the upper guide 23. In this case, which is shown in FIG. 2, the main spring 24 is mechanically coupled to the first armature part 21, which, in turn, guides the valve needle 20.

The axial end 29 of the inlet tube 12 is formed as a first step 43, against which the second armature part 22 hits when the valve needle 20 is actuated.

A filter element 30 is arranged in the inlet tube 12 and forms a further seat for the main spring 24. During the manufacturing process of the injection valve 10 the filter element 30 can be axially moved in the inlet tube 12 in order to preload the main spring 24 in a desired manner. By this the main spring 24 exerts a force on the valve needle 20 towards an injection nozzle 34 of the injection valve 10.

In a closing position of the valve needle 20 it sealingly rests on a seat plate 32 by this preventing a fluid flow through the at least one injection nozzle 34. The injection nozzle 34 may be, for example, an injection hole. However, it may also be of some other type suitable for dosing fluid. In addition to that a lower guide 35 is provided adjacent to the seat plate 32. The lower guide 35 is adapted to guide the valve needle 20 near the injection nozzle 34. The seat plate 32 may be made in one part with the lower guide 35 or a separate part from the lower guide 35.

The valve assembly 11 is provided with an actuator unit 36 that may be an electro-magnetic actuator. The electro-magnetic actuator unit 36 comprises a coil 38, which may be arranged inside the housing 16 and overmolded. Furthermore, the electro-magnetic actuator unit 36 comprises the armature 21, 22. The armature 21, 22 is axially movable in the cavity 18. The armature 21, 22 has a first armature part 21 and a second armature part 22. The first armature part 21 is fixedly coupled to the valve needle 20. The second armature part 22 is axially movable relative to the first armature part 21. The second armature part 22 is arranged relative to the first armature part 21 in axial direction towards a fluid outlet portion 40 which is a part of the cavity 18 near the seat plate 32. The fluid outlet portion 40 communicates with a fluid inlet portion 42 which is provided in the valve body 14.

The housing 16, the inlet tube 12, the first armature part 21 and the second armature part 22 are forming an electromagnetic circuit together with the valve body 14, if the second armature part 22 is of a magnetic material. However, if the second armature part 22 is of a non-magnetic material, only the housing 16, the inlet tube 12 and the first armature part 21 are forming an electromagnetic circuit together with the valve body 14.

The valve assembly 11 has a stop device 44, 46, 48 and the second armature part 22 is axially movable between the first step 43 and the stop device 44, 46, 48.

In the embodiment of FIG. 1, the stop device has a second step 44 which is arranged in the valve body 14. An armature spring 46 which may be a coil spring is fixedly coupled to the step 44 in the valve body 14. The armature spring 46 forms a soft stop element for the second armature part 22 which is axially movable between the first step 43 and the armature spring 46.

In the embodiment of FIG. 2, which shows an arrangement of the first armature part 21, the second armature part 22 and the valve needle 20 in more detail, the stop device has a protrusion 48 which extends in radial direction from the valve needle 20. The protrusion 48 is rigidly coupled to the valve needle 20. In some embodiments, the protrusion 48 is shaped as a ring element. However, the protrusion 48 instead may comprise at least two pin elements extending in radial direction. The protrusion 48 forms a rigid stop element for the second armature part 22 which is axially movable between the first step 43 and the protrusion 48.

In the following, the function of the injection valve 10 is described in detail, thereby referring to the FIG. 3*a* to 3*d:*

The fluid is led from the fluid inlet portion 42 towards the fluid outlet portion 40.

The valve needle 20 prevents a fluid flow through the fluid outlet portion 40 in the valve body 14 in a closing position of the valve needle 20. Outside of the closing position of the valve needle 20, the valve needle 20 enables the fluid flow through the fluid outlet portion 40, whereby the valve needle 20 is in at least one open position. For the purpose of describing the function of the injection valve 10 hereinafter, it is assumed that in a case where the valve needle 20 may be in one of a couple of open positions, when being outside of the closing position, only such a position is deemed to be "the open position", where the valve needle 20 is the furthest off from its closing position.

In the case when the electro-magnetic actuator unit 36 with the coil 38 gets energized the actuator unit 36 may effect a electro-magnetic force on the first armature part 21 and the second armature part 22 (it is assumed, that the second armature part 22 is of a magnetic material). The first armature part 21 and the second armature part 22 are attracted by the electro-magnetic actuator unit 36 with the coil 38 and move in axial direction away from the fluid outlet portion 40. The first armature part 21 and the second armature part 22 take the valve needle 20 with them so that the valve needle 20 moves in axial direction out of the closing position. Outside of the closing position of the valve needle 20 the gap between the valve body 14 and the valve needle 20 at the axial end of the injection valve 10 facing away from of the actuator unit 36 forms a fluid path and fluid can pass through the injection nozzle 34. The valve needle 20 is in its open position.

Figures 3A, 3B, 3C, 3D:
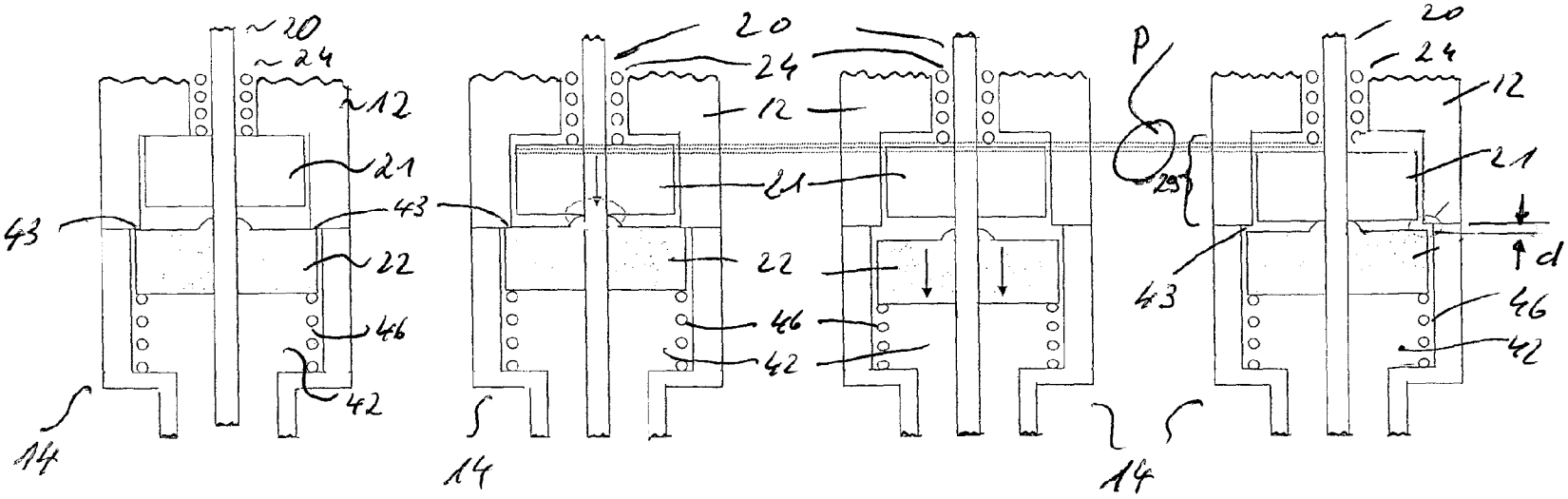
FIGS. 3*a* to 3*d* illustrate different phases of operation of an example construction of the arrangement of FIG. 2.

This situation is shown in FIG. 3*a*: the first armature part 21 is, together with the valve needle 20, in its uppermost position, thereby hitting against a part of the axial end 29 of the inlet tube 12. The second armature part 22 is hit against the first step 43, due to the electromagnetic force caused by the actuator unit 36 and/or due to the force of the armature spring 46. In this position the two armature parts 21, 22 are mechanically decoupled from each other. It has to be noted, that in FIG. 3*a* to 3*d* there is no upper guide 23 arranged; the main spring 24 directly acts onto the first armature part 21, and hence onto the valve needle 20.

In the case when the actuator unit 36 is de-energized (see FIG. 3*b* to 3*d*) the main spring 24 can force against the first armature part 21, and hence can force the valve needle 20 to move in axial direction in its closing position. It is depending on the force balance between the force on the valve needle 20 caused by the actuator unit 36 with the coil 38 and the force on the valve needle 20 caused by the main spring 24 whether the valve needle 20 reaches its closing position or not.

At that moment, when the actuator unit 36 is de-energized, the first armature part 21 leaves its position (due to the force of the main spring 24) and begins to move towards the fluid outlet portion 40 of the valve body 14 of the valve assembly 11. Short afterwards, and this is shown in FIG. 3*b*, the first armature part 21 hits against the second armature part 22. At this moment the first armature part 21 is at a position, which is shown in FIG. 3*b* by the uppermost one of three dotted lines demonstrating different level positions P of the first armature part 21. According to Newton's law, the kinetic energy of the first armature part 21 is transferred to the second armature part 22, thereby slowing down the speed of the first armature part 21. In theory, the first armature part 21 should stop when hitting the second armature part 22, if the mass of the first armature part 21 plus the mass of the valve needle 20 is equal to the mass of the second armature part 22. However, in fact, the first armature part 21 only slows down and accelerates again, because the force of the main spring 24 still acts on it.

Due to the transfer of the kinetic energy from the first armature part 21 to the second armature part 22 the second armature part 22 is decoupled from the first armature part 21, and it is pushed (indicated by arrows) towards the fluid outlet portion 40. This is shown in FIG. 3*c*. At this stage of moving the valve needle 20 into its closing position the first armature part 21 is at a level position P between a maximum level position and a minimum level position, demonstrated by the medium one of said three dotted lines. Finally, when the valve needle 20 has reached its closing position (see FIG. 3*d*), the first armature part 21 is at its minimum level position P, demonstrated by the lowermost one of said three dotted lines. At this position the second armature part 22, which had returned in the meantime, touches the first armature part 21 again at a position, which is at a given distance d from the first step 43. This distance d is necessary, because in practice tolerances have to be taken into account when producing the valve assembly and the injection valve. It is advantageous, if the distance d has a value of 5 to 20 μm.

What is claimed is:

1. A valve assembly for an injection valve, comprising:

a valve body including a central longitudinal axis and a cavity with a fluid inlet portion and a fluid outlet portion, the fluid inlet portion having a first step, a valve needle axially movable in the cavity, the valve needle configured to prevent a fluid flow through the fluid outlet portion in a closing position and to release the fluid flow through the fluid outlet portion in an open position, and an electro-magnetic actuator unit configured to actuate the valve needle, the electro-magnetic actuator unit comprising an armature axially movable in the cavity and a coil disposed surrounding the armature, wherein the armature comprises a first armature part fixedly coupled to the valve needle and a second armature part axially movable relative to the first armature part, the second armature part configured such that during a first opening movement of the valve needle, the second armature part is mechanically coupled to the first armature part such that both the first and second armature parts move in an opening direction of the valve needle until the second armature part hits the first step, after which point the valve needle and the first armature part continue moving in the opening direction such that the first armature part becomes mechanically decoupled from the second armature part, and wherein the first armature part is retained in a mechanically decoupled position until the coil is de-energized.

2. The valve assembly of claim 1, wherein the second armature part is arranged relative to the first armature part in an axial direction towards the fluid outlet portion.

3. The valve assembly of claim 1, wherein the second armature part is axially movable between the first armature part and a stop device.

4. The valve assembly of claim 3, wherein the stop device comprises a second step in the valve body.

5. The valve assembly of claim 3, wherein the stop device comprises an armature spring fixedly coupled to the valve body.

6. The valve assembly of claim 5, wherein the armature spring is a coil spring being coupled to the second step in the valve body.

7. The valve assembly of claim 3, wherein the stop device comprises a protrusion extending in radial direction from the valve needle and being rigidly coupled to the valve needle.

8. The valve assembly of claim 1, wherein the first step and the second armature part are separated by a given distance when the valve needle is in its closing position.

9. The valve assembly of claim 8, wherein the given distance is between 5 μm and 20 μm.

10. The valve assembly of claim 1, wherein the second armature part is formed from a magnetic material.

11. An injection valve comprising:

a valve assembly comprising:

a valve body including a central longitudinal axis and a cavity with a fluid inlet portion and a fluid outlet portion, the fluid inlet portion having a first step, a valve needle axially movable in the cavity, the valve needle configured to prevent a fluid flow through the fluid outlet portion in a closing position and to release the fluid flow through the fluid outlet portion in an open position, and an electro-magnetic actuator unit configured to actuate the valve needle, the electro-magnetic actuator unit comprising an armature axially movable in the cavity and a coil disposed surrounding the cavity, wherein the armature comprises a first armature part fixedly coupled to the valve needle and a second armature part axially movable relative to the first armature part, the second armature part configured such that during a first opening movement of the valve needle, the second armature part is mechanically coupled to the first armature part such that both the first and second armature parts move in an opening direction of the valve needle until the second armature part hits the first step, after which point the valve needle and the first armature part continue moving in the opening direction such that the first armature part becomes mechanically decoupled from the second armature part, and wherein the first armature part is retained in a mechanically decoupled position until the coil is de-energized.

12. The injection valve of claim 11, wherein the second armature part is arranged relative to the first armature part in an axial direction towards the fluid outlet portion.

13. The injection valve of claim 11, wherein the second armature part is axially movable between the first armature part and a stop device.

14. The injection valve of claim 13, wherein the stop device comprises a second step in the valve body.

15. The injection valve of claim 13, wherein the stop device comprises an armature spring fixedly coupled to the valve body.

16. The injection valve of claim 15, wherein the armature spring is a coil spring being coupled to the second step in the valve body.

17. The injection valve of claim 13, wherein the stop device comprises a protrusion extending in radial direction from the valve needle and being rigidly coupled to the valve needle.

18. The injection valve of claim 11, wherein the first step and the second armature part are separated by a given distance when the valve needle is in its closing position.

19. The injection valve of claim 18, wherein the given distance is between 5 μm and 20 μm.

* * * * *